United States Patent [19]

Yellen et al.

[11] 4,068,314

[45] Jan. 17, 1978

[54] JACKET WITH BACK PACK

[75] Inventors: Richard C. Yellen, Rochester, N.Y.; Edward A. Morrell, Wendell, N.C.

[73] Assignee: Champion Products Inc., Rochester, N.Y.

[21] Appl. No.: 666,620

[22] Filed: Mar. 15, 1976

[51] Int. Cl.[2] ..... A41D 1/00

[52] U.S. Cl. ..... 2/94; 224/5 Q

[58] Field of Search ..... 2/94; 224/5 Q, 5 MA, 224/5 BC, 8 R, 12

[56] References Cited

U.S. PATENT DOCUMENTS

| | | | |
|---|---|---|---|
| 1,959,331 | 5/1934 | Bour | 2/94 |
| 2,165,348 | 7/1939 | Daiber | 2/94 |
| 2,304,574 | 12/1942 | Kirschenbaum | 2/94 |
| 2,620,479 | 12/1952 | Buck | 2/94 |

FOREIGN PATENT DOCUMENTS

| | | | |
|---|---|---|---|
| 637,780 | 11/1936 | Germany | 2/94 |

*Primary Examiner*—Doris L. Troutman
*Attorney, Agent, or Firm*—Schovee & Boston

[57] ABSTRACT

A jacket type of garment is provided with a storage or back pack secured to and made part of the garment in such a way that the load of the pack is suspended from a pair of shoulder straps carried within the garment. Upper and lower corners of the storage pack are secured to the straps to distribute load forces from the storage pack to the straps and not to be seams of the jacket, and also to prevent lateral shifting of the lower end of the back pack when it is loaded.

15 Claims, 5 Drawing Figures

JACKET WITH BACK PACK

BACKGROUND AND BRIEF DESCRIPTION OF INVENTION

The present invention relates to an improved garment which includes a storage pack carried on a back portion thereof, and specific features of the invention provide for an improved distribution of load forces from such a storage pack to a pair of continuous loop shoulder straps contained within the garment.

It is generally known in this art to provide jackets or similar articles of apparel with storage pouches or devices attached to back portions thereof so that users can carry small loads on their backs while engaged in other activities such as hiking or bicycling. Many of the prior art proposals appear to be directed to concerns of providing special-purpose carrying pouches, such as game pouches, or with providing design features which offer pleasing or unusual appearances for the finished article. In this sense, many of the prior art efforts have required special designing and fabrication of such garments and therefore have not been adaptable to many present day articles of manufacture.

In addition, there have been attempts to improve the functional features of such garments and to provide structures which will help to distribute loads when certain styles or forms of carrying pouches are attached to jackets. For example, U.S. Pat. No. 2,165,348 discloses a garment structure which includes a pair of shoulder straps secured within a jacket for generally supporting the load of a pack carried externally of the jacket. However, the load in that patent is suspended from a single point of attachment of the shoulder straps to the garment, and therefore, there is no provision for distributing the load of the pack across the entire width of the back of the garment to prevent strain on and distortion of the garment itself and particularly the shoulder seams thereof.

In contrast with known prior art, the present invention provides an improved storage pack for the back of an otherwise conventional light-weight or windbreaker type of jacket, or similar article of apparel, and in particular to improved support for substantially the entire width and height of such a back pack so that load forces from the storage pack are distributed to a pair of shoulder straps contained within the garment in a way that relieves substantially all strain on the garment itself and on all of its seams which might otherwise share some of the load of the storage pack. In addition, the storage pack of the present invention is secured in such a way that its lower end is restrained from lateral shifting movements when it is loaded and a user is moving vigorously in an activity, such as bicycle riding.

More specifically, a preferred embodiment of the present invention provides for a storage pack formed from back, side, and bottom panels which are secured to an outside surface of a back portion of a jacket type of garment so as to provide, with the back portion of the garment, an enclosed structure having an open top for receiving a load therein. A pair of straps are secured to an inner surface of the back portion of the garment so as to provide a pair of loop structures which can be placed over the shoulders and under the arms of a user when the garment is worn. The straps are secured to the back portion of the garment at points which provide support for upper and lower corners of both sides of the storage pack to thereby (a) distribute load forces from the storage pack to both of the straps and (b) prevent lateral shifting of the lower end of the storage pack when a load is contained therein. Finally, it is preferred that releasable fastening means be provided on the back panel of the storage pack, proximate the open top thereof, for securing the back panel directly to the straps carried within the garment to thereby suspend any loading forces on the back panel from the straps when the pack is loaded and closed. In another preferred aspect of the present invention, the shoulder straps are of continuous, one-piece non-adjustable loop construction.

The garment of the present invention is easily manufactured and assembled with conventional jacket components and designs, and thus, there is no requirement for substantial change in designs or fabrication techniques for existing manufacturing facilities. The completed garment is easy to use, is pleasing in appearance, and is functionally superior to known prior art garments of this type.

These and other features and advantages of the invention will become more apparent in the detailed discussion which follows, and in that discussion reference will be made to the accompanying drawings as briefly described below.

BRIEF DESCRIPTION OF THE INVENTION

Figure 1:
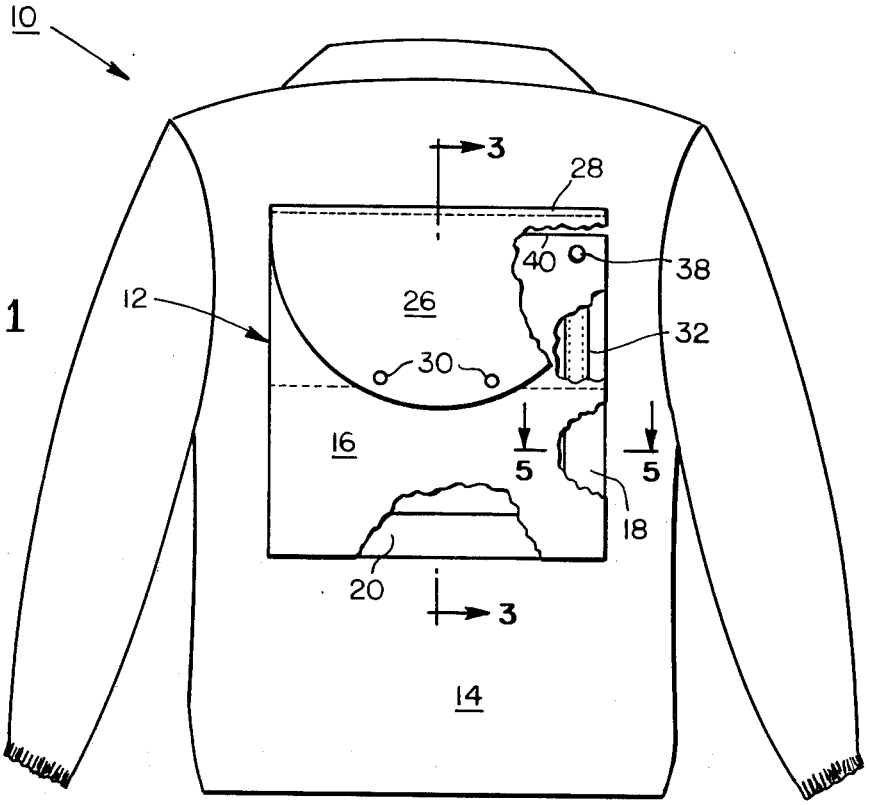
FIG. 1 is an elevational view from the back of a garment carrying a storage pack having the improved features of the present invention.
Figure 2:
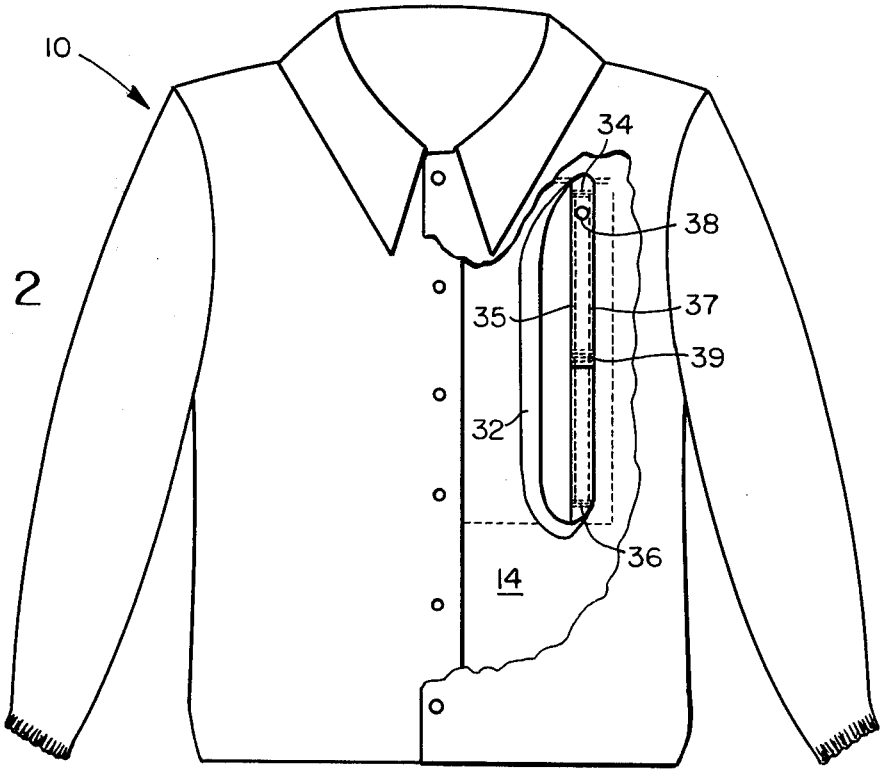
FIG. 2 is a front elevational view of the garment shown in FIG. 1, with a portion thereof cut away to reveal the securement of one continuous loop strap therein.

FIGS. 1 and 2 illustrate the invention as applied to a jacket type of garment 10 which includes a storage pack 12 carried on a back portion 14 of the garment 10. The illustrated jacket may be manufactured from any known fabric or material, and may comprise, for example, a light-weight jacket formed from a synthetic fabric (preferably nylon) which offers good rain repellancy and wind resistance. In this sense, the garment 10 comprises a conventional garment manufactured from known materials and sewn together or otherwise assembled in a known manner. As shown in FIG. 2, the front of the garment 10 may typically be provided with buttons (as illustrated) or a slide fastener (not illustrated) for closing front panels of the jacket when it is worn.

The storage pack 12 is secured to the back portion 14 of the garment 10 in a mid-shoulder area of the garment. As shown in greater detail in FIGS. 3–5, the storage pack 12 is formed from a back panel 16, side panels 18

(see FIG. 5), and a bottom panel 20 which are secured to each other and to the back portion 14 of the garment 10 to provide, with the back portion 14, an enclosed structure having an open top for receiving a load therein. Thus, the back portion 14 of the garment 10 serves to provide one of the walls of the storage pack 12 after the storage pack panels 16, 18, and 20 are secured together and to the garment in the illustrated relationships. The panels 16, 18, and 20 may comprise separate pieces of material which are sewn together to fashion the illustrated structure, or they may be formed from one or more integral pieces of material to provide the shape and dimensions of the storage pack 12. Although the side panels 18 and the bottom panels 20 are illustrated as being sewn to the material of the garment 10 (along seams 22 and 24, respectively), it can be appreciated that other arrangements may be provided for securing the storage pack to a conventional jacket or other garment. For example, a number of snap fasteners may be positioned about the back portion 14 of the garment to mate with a corresponding number of snap fasteners carried by appropriate panel members of a separate storage pack to be secured thereto.

Figure 3:
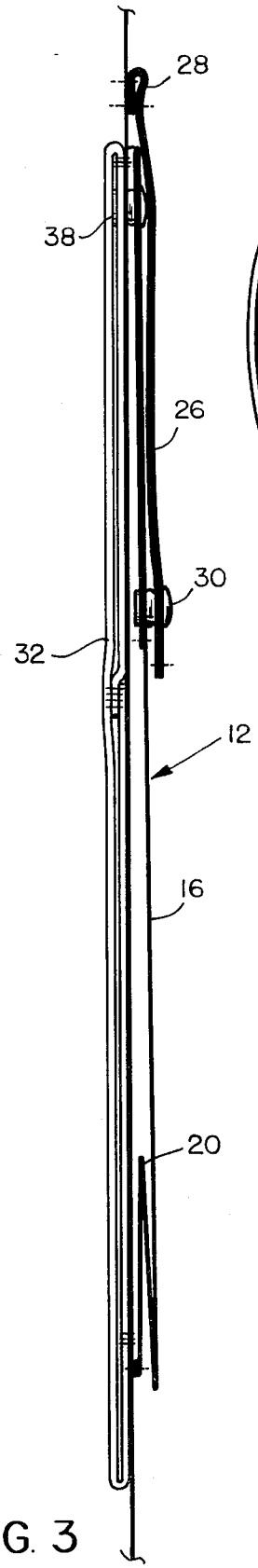
FIG. 3 is a side elevational view, in section and in enlarged scale from the scale used in FIGS. 1 and 2, showing relationships of panels making up the storage pack and a back portion of a garment when the storage pack is in an empty or collapsed condition.
Figure 4:
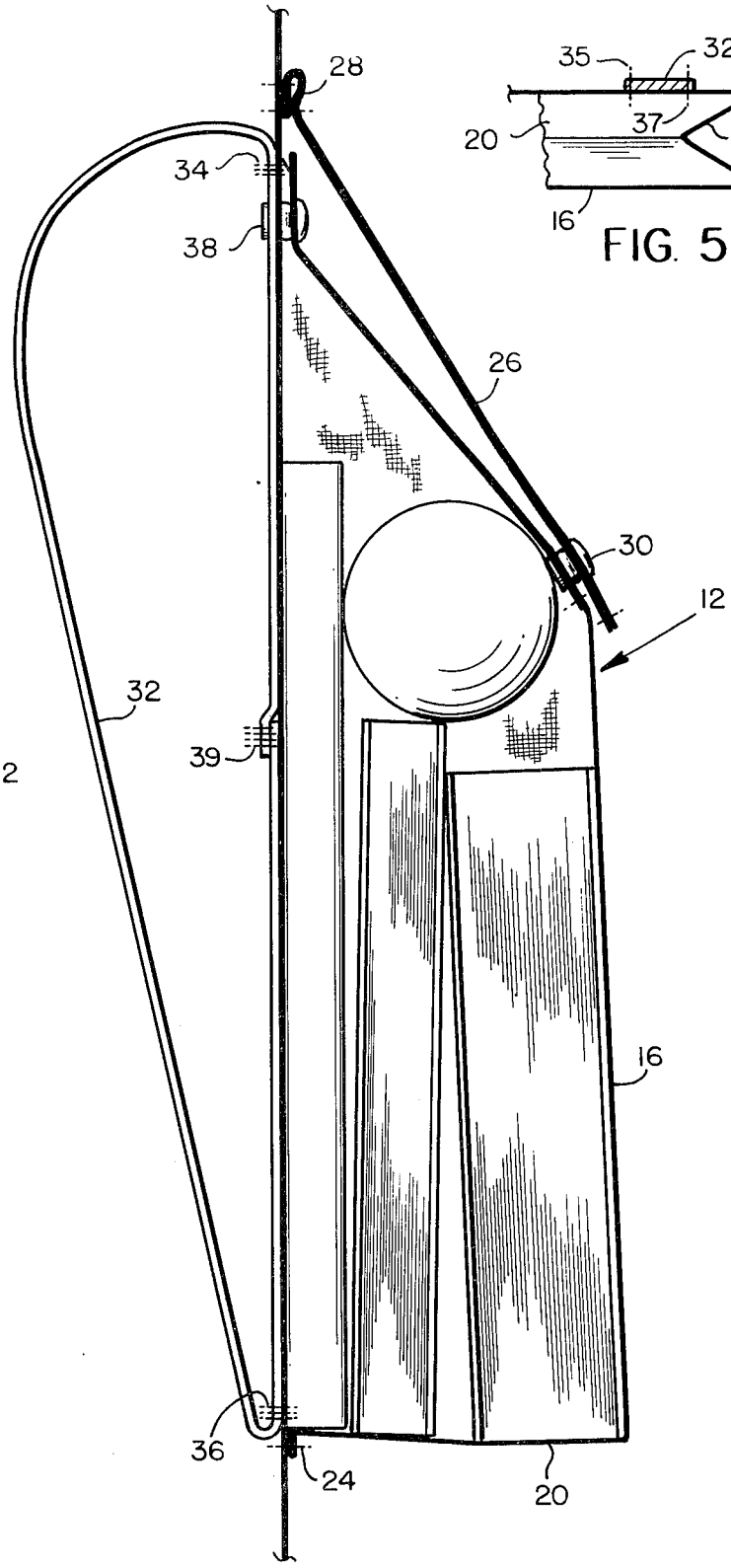
FIG. 4 is an elevational view, in section and in the same scale as FIG. 3, showing the basic relationships of FIG. 3 after the storage pack is loaded with various articles such as books and a ball, and the shoulder straps are extended for use.
Figure 5:
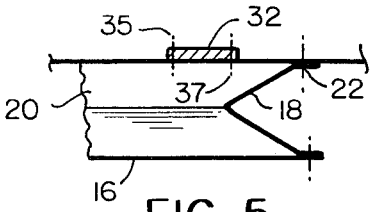
FIG. 5 is a sectional view of a portion of FIG. 1, as seen on line 5—5 thereof, showing a detail of the storage pack and a strap, as secured to the back portion of the garment.

In addition to the basic structures which have just been described, the storage pack 12 is preferably also provided with a top flap member 26 so that the open top of the storage pack can be covered and closed. In the illustrated embodiment, the flap member 26 is secured to the back 14 of the garment by being sewn thereto along a seam at 28. Releasable snap fasteners 30 are preferably provided at a lower end of the flap member 26 and at a mid level of the back panel 16 of the storage pack so that the flap member 26 can be releasably secured over the upper end of the storage pack, as shown in FIGS. 1, 3 and 4.

Up to this point, the garment and storage pack which have been described constitute conventional structures which are designed, fabricated and related to one another in ways which are well-known in this art. However, a garment including only these well-known structures would be unsatisfactory in many respects of nothing more were done to its structural and functional features. For one thing, the long-term integrity of the combined jacket and storage pack would be unsatisfactory for most consumers if all of the load forces from the storage pack load were carried solely by the seams or other securing devices which are used for attaching such a storage pack to a jacket type of garment. The seams at the point of attachment would be overly stressed, and, in addition, load forces would be transmitted to other seams of the garment which are typically provided in the shoulder and the upper back areas. From a functional standpoint, a simple combination of a storage pack with a jacket would be awkward to wear, and there would be a tendency for the loaded storage pack to pull the jacekt downwardly from the neck and shoulder areas of a user. Also, there would be a tendency for the load of the storage pack to shift from side to side if the garment were being worn while riding a bicycle or with its front panels open, and this tendency would result in a twisting and pulling of the entire garment from side to side during use.

The present invention provides for a structurally improved and functionally more acceptable combination of a storage pack with a garment through the use of a pair of strategically positioned straps 32 (only one of which is shown in FIG. 2; the other strap being partly shown in FIG. 1 and being identical to the strap shown in FIG. 2) The straps 32 are secured to an inner surface of the back portion 14 of the garment 10 so as to provide a pair of loop structures which can be placed over the shoulders and under the arms of a user when the garment is worn. With reference to the FIG. 1 and FIG. 2 views, the pair of straps 32 are spaced-apart from each other horizontally a distance somewhat less than the overall width of the storage pack, further the pair of straps are attached vertically to the back portion of the garment a distance somewhat less than the overall height of the storage pack. The straps 32 are secured to the back portion 14 of the garment at points which provide support for upper and lower corners (such as by the horizontal stitching at 34 and at 36) of the storage pack area so that the pair of straps together receive load forces which are distributed across the width and height of the storage pack area.

In addition to the features just described, a further important feature of the present invention provides for a suspension of loading forces on the back panel 16 of the storage pack itself from the pair of straps 32 so that there will be little or no tendency for the pack to sag or to strain its side seams at points of attachment to the garment 10. This is accomplished by providing releasable fastening means 38 in positions for securing an upper end 40 of the back panel 16 to the straps 32 to thereby transmit load forces from the back panel 16 to the straps 32. It is important to transmit these load forces to the straps themselves, and not just to a backwall of the garment (as shown in U.S. Pat. No. 2,079,220, for example), because otherwise the pack will apply a large stress to the garment material and to its seams. The snaps 38 can be unsnapped to provide an enlarged opening into the storage pack, but are preferably snapped closed again, as shown in FIG. 4, after the storage pack is loaded. The releasable fastening means 38 are illustrated in the form of snap fastener devices made up of two separate, mating elements for being releasably secured to one another. One element of each snap fastener device is secured through an associated strap 32 and through the back portion of the garment 10 so as to mate with the other element of the snap fastener device carried on the upper end of the back panel 16 proximate to the open top of the storage pack.

Preferably, the straps 32 are formed as continuous loop structures within the garment so that a portion of the contiunous loop structure is secured vertically to the back portion of the garment to support upper and lower corners of the storage pack, and another portion of the continuous loop structure remains free for being placed over a shoulder and under the arm of a user. Although the secured portion of the straps 32 (as illustrated in FIG. 2) has been discussed with reference to points of securement at 34 and 36, it is preferred that additional stitching be provided between those two points 34 and 36 as along both sides of the entire length of the straps as at 35 and 37 in FIG. 2. The stitching 39 in FIG. 2 is that used to secure together the two ends of the straps 32, before the strap is sewn to the back panel 14 of the garment 10. The straps 32 may be formed from nylon, cotton woven material, or from other known fabric structures, but preferably a material is selected which will offer the desired strength and which will additionally tend to stay in place on the body of a user without slipping away from preferred positions over the shoulder areas.

It is another aspect of the present invention that the straps 32 can comprise continuous one-piece loops having identical, fixed lengths which are non-adjustable. This eliminates any requirement for loose, dangling ends of straps, and for bulky hardware for adjustment features, and yet, a single size of a one-piece continuous loop provides a very satisfactory fit. The loop portions of the straps confortably embrace the shoulder and under arm areas of a user without restricting movement of the arms. The sizing provides for a good fit and feel of the garment and any load contained in its storage pack, and additionally, the relatively snug fit of the pair of straps to the user prevents unwanted lateral shifting of the loaded storage pack from side to side even when the garment is worn in an opened condition at its front. Thus, the type and placement of the straps serves to restrain lateral load shifting as well as to distribute and carry vertical load forces.

For example, for a medium size jacket, the dimensions fo a preferred pack are: width about 13 inches, height about 16½ inches, depth about 5 inches, and shoulder straps having a width of 1 inch and a circumference of about 36 inches with the attached length to the jacket being about 14 inches.

Although the invention has been described with reference to a specific embodiment, it can be appreciated that certain changes can be made in the structures and relationships discussed above without departing from the basic concepts of this invention. Equivalent structures and relationships to those discussed are intended to be included within the scope of protection sought herein as defined in the claims below.

What is claimed is:

1. In a garment of a type which can be worn as a jacket or similar article of apparel and which includes a storage pack carried on a back portion thereof, the improvement comprising a storage pack formed from back, side and bottom panels which are secured to an outside surface of a back portion of said garment so as to provide, with said back portion of the garment, an enclosed structure having an open top for receiving a load therein, a pair of shoulder straps secured to said back portion of said garment and comprising a pair of loop structures which can be placed over the shoulders and under the arms of a user when the garment is worn, said straps being secured to said back portion of the garment at points which provide support for upper and lower corners of both sides of said storage pack to thereby (a) distribute load forces from the storage pack to both of the straps and (b) prevent lateral shifting of upper and lower ends of the storage pack when a load is contained therein, and releasable fastening means carried on said back panel of said storage pack proximate the open top thereof for securing the back panel to said straps to thereby suspend any load forces on the back panel from said straps.

2. The garment of claim 1 wherein each of said straps is formed as a substantially continuous loop structure within said garment with a portion of said continuous loop structure being secured to an inner surface of the back portion of said garment at locations to support upper and lower corners of said storage pack and with another portion of said continuous loop structure remaining free for being placed over a shoulder and under an arm of a user.

3. The garment of claim 2 wherein said straps extend vertically along the back portion of the garment and parallel to each other with each strap being adjacent one side, respectively, of the storage pack.

4. The garment of claim 3 wherein each of said straps is stitched to the back portion of the garment with substantially horizontal stitching at locations adjacent the top and bottom edges of the storage pack and with vertical stitching along each edge of each strap along substantially its entire length.

5. The garment of claim 1 wherein each of said straps is a fixed non-adjustable, length, forming a one-piece loop.

6. The garment of claim 1 wherein each of said releasable fastening means comprises a snap fastener having a first part thereof secured to said back panel and having a mating part thereof secured through one of said straps.

7. The garment of claim 1 and including a flap member secured to the back portion of said garment at a position above the open top of said storage pack for covering the open top of the storage pack.

8. The garment of claim 7 and including releasable fastening means on said flap member for releasably securing said flap member to the back panel of said storage pack.

9. The garment of claim 8 wherein each of said straps is formed as a substantially continuous loop structure within said garment with a portion of said continuous loop structure being secured to an inner surface of the back portion of said garment at locations to support upper and lower corners of said storage pack and with another portion of said continuous loop structure remaining free for being placed over a shoulder and under an arm of a user.

10. The garment of claim 9 wherein each of said straps is a fixed non-adjustable, length, forming a one-piece loop.

11. The garment of claim 10 wherein said straps extend vertically along the back portion of the garment and parallel to each other with each strap being adjacent one side, respectively, of the storage pack.

12. The garment of claim 11 wherein each of said straps is stitched to the back portion of the garment with substantially horizontal stitching at locations adjacent the top and bottom edges of the storage pack and with vertical stitching along each edge of each strap along substantially its entire length.

13. A method for providing a jacket with a back pack that, when loaded, will not distort the jacket comprising the steps of providing a back pack with integral back, side, and bottom panels, securing said integral panels to an outside surface of a back portion of the garment so as to provide an enclosed structure having an open top for receiving a load therein, and securing a pair of shoulder straps to an inside surface of said back portion of said jacket adjacent upper and lower corners of both sides of said back pack to thereby (a) distribute load forces from the storage pack to both of the straps and (b) prevent lateral shifting of upper and lower ends of the storage pack when a load is contained therein while providing a free portion of each strap for being placed over a shoulder and under an arm of a user, and securing releasable fastening means on the back panel of said back pack proximate the open top thereof for securing the back panel to said straps to thereby suspend any loading forces on the back panel from said straps.

14. The method according to claim 13 wherein said strap securing step comprises locating the secured portion of said straps in vertically extending, parallel, spaced-apart relationship to each other with each secured portion being adjacent a respective side of said back pack.

15. The method according to claim 13 wherein said strap securing step includes securing a pair of continuous, one-piece, loop construction straps to said back portion.

* * * * *